US011085250B2

(12) United States Patent
Søyland

(10) Patent No.: US 11,085,250 B2
(45) Date of Patent: Aug. 10, 2021

(54) SAFETY DEVICE FOR ATTACHING TO A PIPE STRING COMPRISING A PLURALITY OF CONNECTED PIPE SECTIONS

(71) Applicant: Canrig Robotic Technologies AS, Sandnes (NO)

(72) Inventor: Svein Søyland, Kvernaland (NO)

(73) Assignee: Canrig Robotic Technologies AS, Sandnes (NO)

( * ) Notice: Subject to any disclaimer, the term of this patent is extended or adjusted under 35 U.S.C. 154(b) by 0 days.

(21) Appl. No.: 16/623,228

(22) PCT Filed: Jun. 15, 2018

(86) PCT No.: PCT/NO2018/050159
§ 371 (c)(1),
(2) Date: Dec. 16, 2019

(87) PCT Pub. No.: WO2018/231068
PCT Pub. Date: Dec. 20, 2018

(65) Prior Publication Data

US 2020/0165882 A1 May 28, 2020

(30) Foreign Application Priority Data

Jun. 16, 2017 (NO) ..... 20170991

(51) Int. Cl.
*E21B 19/10* (2006.01)
*E21B 40/00* (2006.01)
*E21B 19/12* (2006.01)

(52) U.S. Cl.
CPC ..... *E21B 19/10* (2013.01); *E21B 19/12* (2013.01); *E21B 40/00* (2013.01)

(58) Field of Classification Search
CPC ..... E21B 19/10; E21B 19/16; E21B 19/161; E21B 19/163; E21B 19/164; E21B 40/00; E21B 41/0021
See application file for complete search history.

(56) References Cited

U.S. PATENT DOCUMENTS 343,668 A * 6/1886 Looney ..... B25B 13/16 81/108
1,454,319 A * 5/1923 Hamer ..... E21B 19/161 81/175

(Continued)

FOREIGN PATENT DOCUMENTS

CN 104563918 A * 4/2015
GB 191405303 A * 9/1914 ..... E21B 19/10

(Continued)

OTHER PUBLICATIONS

International Search Report from PCT/NO2018/050159, dated Sep. 7, 2018, 8 pgs.

(Continued)

*Primary Examiner* — Jennifer H Gay
(74) *Attorney, Agent, or Firm* — Abel Schillinger, LLP; Enrique Abarca

(57) ABSTRACT

A safety device (20) for attaching to a pipe string (10) comprising a plurality of connected pipe sections (12). The device is configured, comprises a support structure (22) and a clamping arrangement (24) comprising a first engagement member (32) and a second engagement member (34), which clamping arrangement (24) comprises a disengaged state and an engaged state. The support structure comprises a recess (30) adapted to receive the envelope surface of the pipe section. The first engagement member and the second engagement member are arranged in different parts of the recess so that opposite sides of the pipe section are clamped (Continued)

between the first engagement member and the second engagement member when the clamping arrangement is in the engaged state.

11 Claims, 5 Drawing Sheets

(56) References Cited

U.S. PATENT DOCUMENTS 1,713,694 A * 5/1929 Elliott ..... E21B 19/16 81/472
1,811,666 A * 6/1931 Foster ..... E21B 19/164 81/57.13
1,885,605 A * 11/1932 Kightlinger ..... E21B 19/161 81/91.3
1,919,468 A * 7/1933 Jones ..... E21B 19/161 81/90.4
1,923,010 A * 8/1933 Johansen ..... E21B 19/164 81/57.15
2,008,806 A * 7/1935 Gould ..... E21B 40/00 175/423
2,197,908 A * 4/1940 Wellborn ..... E21B 19/16 166/77.51
2,229,607 A * 1/1941 Poist ..... E21B 19/10 24/114.5
2,305,624 A * 12/1942 Lange ..... E21B 19/164 81/57.18
2,417,085 A * 3/1947 Mullinix ..... E21B 19/161 81/99
2,556,536 A * 6/1951 Harris ..... E21B 19/167 81/55
2,615,682 A * 10/1952 Stone ..... E21B 19/16 81/57.21
2,721,491 A * 10/1955 Klitzke ..... B21J 7/24 173/93
3,037,258 A 6/1962 Strokes
3,141,362 A * 7/1964 Tamny ..... E21B 19/167 81/57.16
3,330,552 A * 7/1967 Siegfried ..... E21B 19/161 269/55
3,340,754 A * 9/1967 Burchett ..... B25B 13/26 81/356
3,472,535 A 10/1969 Kinley
3,514,822 A * 6/1970 Guier ..... E21B 19/10 414/744.2
3,961,399 A 6/1976 Boydjieff
4,567,952 A 2/1986 Lemaire et al.
4,621,974 A 11/1986 Krueger
5,062,756 A * 11/1991 McArthur ..... E21B 19/14 414/22.51
7,337,861 B2 * 3/2008 Mong ..... E21B 19/12 175/423
7,467,676 B2 * 12/2008 Mong ..... E21B 19/12 175/423
7,942,081 B2 * 5/2011 Hauk ..... E21B 19/164 81/57.19
9,057,246 B2 * 6/2015 O'Blenes ..... E21B 41/0021
10,370,913 B2 * 8/2019 Soyland ..... B25J 19/0045
10,746,268 B2 * 8/2020 Rivera ..... E21B 19/16
10,774,601 B2 * 9/2020 Soyland ..... F16B 2/185
2005/0072882 A1 * 4/2005 Mong ..... E21B 19/12 248/74.1
2008/0093091 A1 * 4/2008 Mong ..... E21B 19/12 166/382
2010/0050817 A1 * 3/2010 Hauk ..... E21B 19/165 81/57.33
2011/0259576 A1 10/2011 Mulder et al.
2013/0112479 A1 * 5/2013 O'Blenes ..... E21B 41/0021 175/40
2017/0328149 A1 * 11/2017 Soyland ..... E21B 19/14
2019/0136669 A1 5/2019 Wiedecke et al.
2019/0309586 A1 * 10/2019 Soyland ..... E21B 19/168
2020/0165882 A1 * 5/2020 Soyland ..... E21B 41/0021

FOREIGN PATENT DOCUMENTS

GB 2168281 A * 6/1986 ..... B25B 13/505
WO 03/054343 A1 7/2003
WO 2016089216 A1 6/2016

OTHER PUBLICATIONS

Written Opinion of the International Preliminary Examining Authory from PCT/NO2018/050159, dated Jun. 28, 2019, 6 pgs.
International Preliminary Report on Patentability from PCT/NO2018/050159, dated Sep. 9, 2019, 11 pgs.

* cited by examiner

SAFETY DEVICE FOR ATTACHING TO A PIPE STRING COMPRISING A PLURALITY OF CONNECTED PIPE SECTIONS

CROSS REFERENCE TO RELATED APPLICATION(S)

The present application is a national stage filing under 35 USC 371 of International Application No. PCT/NO2018/050159, filed on 15 Jun. 2018, which claims priority to a Norwegian Patent No. NO20170991, filed on 16 Jun. 2017. The entire disclosures of these prior applications are incorporated herein by this reference.

INTRODUCTION

The present invention relates to a safety device for attaching to a pipe string comprising a plurality of connected pipe sections. The safety device is configured, in the event of a slippage of the pipe string, to be displaced with the pipe string into contact with an assembly of wedged slips employed to the pipe string, and thereby interacting with the assembly of wedged slips so that a force from the assembly of wedged slips to the pipe string is further increased.

PRIOR ART

The drilling operation of a hydrocarbon well comprises the steps of establishing and connecting pipe sections, together to a gradually longer pipe string. The operation takes place at a rig floor comprising an opening down through which the pipe string is extending. The pipe string is extended by connecting further pipe sections to the pipe string above the rig floor and gradually shifting the pipe string down in the opening of the rig floor.

The pipe string often comprises a large number of pipe sections connected together and constituting a significant weight. During connecting further pipe sections to the pipe string, the pipe string is held firmly at the assembly table/rig floor by means of an assembly of wedged slips, often simply called "slips", that is suspended in the assembly table. In the event that the pipe string would start slipping through the assembly of wedged slips and down through the assembly table, a collar of a pipe section of the pipe string would contact the assembly of wedged slips and due to the wedge shape of the slips gradually increase the force in which the pipe string is connected to the assembly of wedged slips. Accordingly, the pipe string would be further wedged at the opening in the assembly table until it would be brought to a static state.

In the case where the pipe string is compiled of pipe sections without collars, i.e. so-called flush type pipes with a uniform diameter along their full length, a safety device in form of a belt connected around the envelope surface of the pipe section above the assembly of wedged slips is used. Examples of such flush type pipes are e.g. drill collars, bottom hole assemblies (BHAs) and liners Correspondingly, in the event that the pipe string would start slipping through the assembly of wedged slips and down through the assembly table, the belt would be displaced with the connected pipe section into contact with the assembly of wedged slips and act on the assembly of wedged slips so that the force subjected from the assembly of wedged slips on the pipe string is increased, thereby preventing the pipe string from slipping further down into the assembly table.

A problem with prior art safety devices in the form of belts connected around the envelope surface of the pipe section, is that it is time consuming to attach and detach the belt from the pipe section as the pipe string is gradually compiled and allowed to be displaced down through the assembly table. Furthermore, prior art safety devices require manual attachment and detachment to/from the pipe section. Accordingly, the prior art safety device prevents the establishment of the pipe string in an automated manner.

SUMMARY OF THE INVENTION

The invention has for its object to remedy or to reduce at least one of the drawbacks of the prior art, or at least provide a useful alternative to prior art. A first object of the invention is to provide a safety device that can be attached and detached in a quick and reliable manner to a pipe section of a pipe string. A second object of the invention is to provide a safety device that is configured to be operated in an automated manner by means of a robot unit for the connection to a pipe section of a pipe string.

These objects are achieved by means of a safety device for attaching to a pipe string comprising a plurality of connected pipe sections. The safety device is configured, in the event of a slippage of the pipe string, to be displaced with the pipe string into contact with assembly of wedged slips employed to the pipe string, thereby interacting with the assembly of wedged slips so that a force from the assembly of wedged slips to the pipe string is further increased. The safety device comprises a support structure and a clamping arrangement comprising a first engagement member and a second engagement member, which clamping arrangement comprises a disengaged state in which the pipe section is freely movable in respect to the device and an engaged state in which the device is firmly connected to the pipe section, wherein the support structure comprises a recess adapted to receive the envelope surface of the pipe section, and wherein the first engagement member and the second engagement member are arranged in different parts of the recess so that opposite sides of the pipe section are clamped between the first engagement member and the second engagement member when the clamping arrangement is in the engaged state.

By means of the recess and the clamping arrangement, the pipe section of the pipe string can quickly be introduced into the device whereupon a firm connection to the pipe section is establish by changing the clamping arrangement from the disengaged state to the engaged state. In the engaged state, the first engagement member and the second engagement member arranged in the recess act on opposite sides of the pipe section, and thereby forming a firm connection of the device to the pipe section. Correspondingly, after the pipe string has been shifted down into the opening of the assembly table and a further pipe section has been added to the pipe string, the safety device can quickly and easy be disconnected from the pipe string and connected to the further pipe section. The safety device has further the advantage of enabling employment in an automated manner, such as by means of a robot unit.

The pipe section is typically a tubular elongated element. The pipe section comprises connection means, such a threading for connection to another pipe section.

According to an embodiment of the invention, the safety device comprises a clamping mechanism for moving at least one of the first engagement member and the second engagement member towards and away from each other, thereby changing the clamping arrangement between the engaged state and the disengaged state. The clamping mechanism is adapted to be induced in an automated manner, such as by mean of a robot unit connecting to the device.

According to an embodiment of the invention, the clamping mechanism is configured to displace at least one of the first engagement member and the second engagement member towards and away from each other. The displacement of the engagement member is such that the first engagement member and the second engagement member are, starting from the disengaged state, brought closer to each other until contacting the envelope surface of the pipe section in the engaged state.

According to an embodiment of the invention, the clamping mechanism is configured to act on at least the first engagement member with a force that displaces the first engagement member towards and away from the second engagement member. The engaged state is arranged such that the first engagement member and second engagement member act with a force on the envelope surface of the pipe section, thereby clamping the pipe section between the two engagement members.

According to an embodiment of the invention, the first engagement member is rotationally arranged in respect to the support structure, and wherein clamping mechanism is configured to induce a rotation of the first engagement member so that the first engagement member is rotated towards and away from the second engagement member, thereby changing the clamping arrangement between the engaged state and the disengaged state.

According to an embodiment of the invention, the first engagement member comprises an arm and the clamping arrangement comprises a pivot between the arm and the support structure, wherein the clamping mechanism is configured to act on the arm with a force that rotates the first arm towards and away from the second engagement member. By means of the rotation of the arm in relation to the support structure, the clamping arrangement is changed between the disengaged state and the engaged state.

According to an embodiment of the invention, the clamping mechanism comprises an elongated sleeve element with an elongated opening comprising a primary threading, and a displacement rod comprising a secondary threading, wherein the displacement rod is arranged in the opening so that said primary threading and secondary threading engage with each other. By means of configuring the sleeve element and the displacement rod with the respective primary and secondary threading, the displacement rod is arranged displaceable by means of a rotation of the sleeve element, whereby the clamping mechanism may act as a linear actuator operable by rotation of said sleeve.

According to an embodiment, an outer envelope surface of the sleeve element is adapted to engage with a rotating roll of a tool for setting the sleeve element into rotation, such as a rotating roll provided on a gripper controllable by means of a robot unit. An example of a suitable gripper is disclosed in WO2016/089216.

According to an embodiment of the invention, said primary threading and secondary threading are arranged to engage with a friction that holds the elongated sleeve element and the displacement rod fixed when the clamping arrangement is in the engaged state. By means of arranging the friction above a certain level, it is assured that the disengaged state and engaged state of the clamping arrangement are maintain if a force subjected to the first engagement member and the second engagement member is below certain level.

According to an embodiment of the invention, the device comprises a compartment within the device comprising a lubricant provided in connection to the primary threading and secondary threading.

According to an embodiment of the invention, the support structure further comprises a holding means for enabling the device to be held while allowing the sleeve element to be set into rotation. According to an embodiment, the holding means is a bar extending along the sleeve element with a separation from the sleeve element. Preferably, the holding means is configured for being gripped by a robot unit, such as by means of the gripper mentioned above.

According to an embodiment of the invention, the sleeve element comprises connection means adapted to enable connection to a robot arm for enabling the sleeve element to be set into rotation in relation to its longitudinal axis. The connection means relates to a configuration of the device that enables the device to be gripped and moved to a different location, such as to a further pipe section that has been compiled to the pipe string.

According to an embodiment of the invention, the sleeve element comprises further connection means adapted to enable connection to a tool for enabling the sleeve element to be set into rotation in relation to its longitudinal axis.

According to an embodiment of the invention, at least a portion of the displacement rod may be formed with a non-circular cross-section fitting complementary and slidingly into a non-circular opening/recess/bushing in the device, whereby rotation of the displacement rod and thereby also the first engagement member, may be avoided. Accordingly, by means of the non-circular portion of the displacement rod, the first engagement member is displaced linearly relative to the second engagement member without rotation. The non-circular portion may be formed with any cross-section preventing the displacement rod from rotating. In certain embodiments, the non-circular portion of the displacement rod may be quadratic or rectangular.

According to an embodiment of the invention, the first engagement member and a second engagement member comprises a respective contact member comprising a friction pad for contacting an envelope surface of the pipe section.

According to an embodiment of the invention, the first engagement member and a second engagement member comprises a respective dies.

According to an embodiment of the invention, the sleeve element comprises a spring element adapted to be compressed when the clamping arrangement is changed from the disengaged state to the engaged state. Thereby, once the clamping arrangement has been changed to the engaged state, the engaged stated is configured to be maintained by means of the spring element until the clamping arrangement is shifted to the disengaged stated. The spring element is an element providing a force when being compressed. The spring element is for example various types of springs, such as a coil spring, a gas spring, etcetera.

The objects of the invention are further obtained by means of a safety system comprising a safety device according to any of above mentioned embodiments and assembly of wedged slips.

According to an embodiment of the invention, the system further comprises a robot unit comprising a gripper.

According to an embodiment of the invention, the robot arm comprises means for engaging with and setting the sleeve element of the safety device into rotation.

The objects of the invention are further obtained by means of use of a safety device and use of a safety system according to above embodiments of the invention.

BRIEF DESCRIPTION OF DRAWINGS

In the following is described examples of preferred embodiments illustrated in the accompanying drawings, wherein.

DETAIL DESCRIPTION OF THE INVENTION

Figure 1:
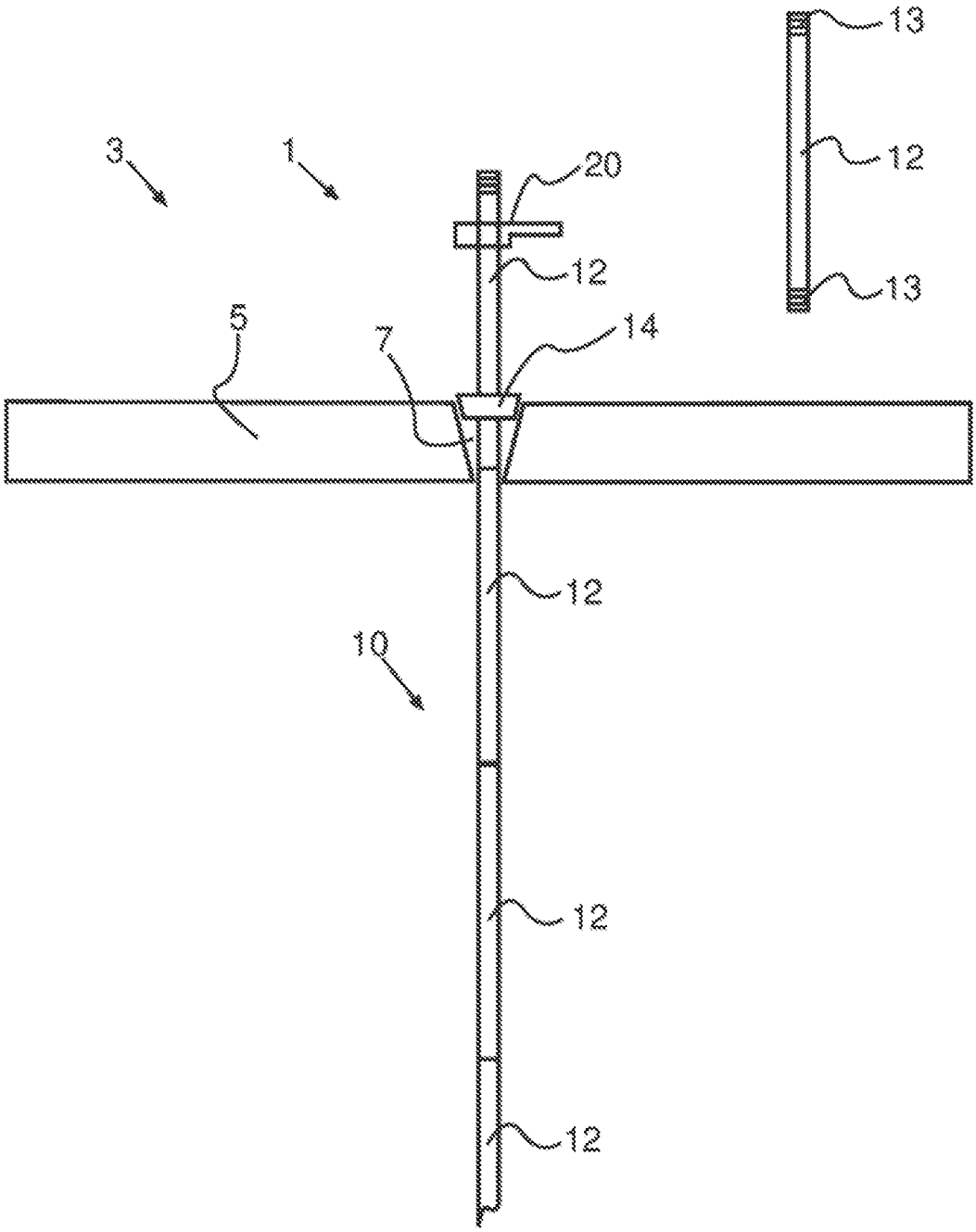
FIG. 1 discloses a schematic view of safety system comprising a safety device according to an embodiment of the invention.

In FIG. 1 is a safety system 1 according to an embodiment of the invention disclosed. The system 1 is employed at a drilling arrangement 3 for a hydrocarbon well. The drilling arrangement 3 comprises an assembly table/rig floor 5 with an opening 7 through which a pipe string 10 is extending down to the hydrocarbon well. The pipe string 10 comprises a plurality of pipe sections 12. In FIG. 1, four connected pipe sections 12 of the pipe string 10 are seen and a further pipe section 12 is about to be connected to the pipe string 10.

Each pipe section 12 comprises respective threading 13 at the end portions for connection to further pipe sections 12. During the drilling operation, the pipe string 10 is gradually extended by connecting further pipe sections 12 to the pipe string 10 above the assembly table 5 and gradually shifting the pipe string 10 down the opening 7 of the assembly table 5.

The pipe string 10 often comprises a large number of pipe sections 12 connected together and constituting a significant weight. During connecting further pipe sections 12 to the pipe string 10, the pipe string 10 is held firmly at the assembly table 5 by means of assembly of wedged slips 14 that is suspended in the assembly table 5 at the opening 7. In FIG. 1, the assembly of wedged slips 14 is schematic illustrated as a single wedged shaped unit. It shall however be understood that the assembly of wedged slips 14 normally comprises a plurality of wedged parts arranged to a unit.

The system 1 further comprises a safety device 20 attached to an envelope surface of a pipe section 12 of the pipe string 10 above the assembly table 5 and the assembly of wedged slips 14. In an event that the pipe string 10 would start slipping through the assembly of wedged slips 14 and down through opening 7 in the assembly table 5, the safety device 20 is displaced together with the pipe string 10 into contact with the assembly of wedged slips 14 and thereby acting on the assembly of wedged slips 14 so that the force subjected by the assembly of wedged slips 14 on the pipe string 10 is increased. Thereby, the force subjected by the assembly of wedged slips 14 on the pipe section 12 is increased until the pipe string 10 is stopped from slipping further down into the opening 7 of the assembly table 5.

The safety device 20 will be explained in further details with reference to FIGS. 2-5.

Figure 2:
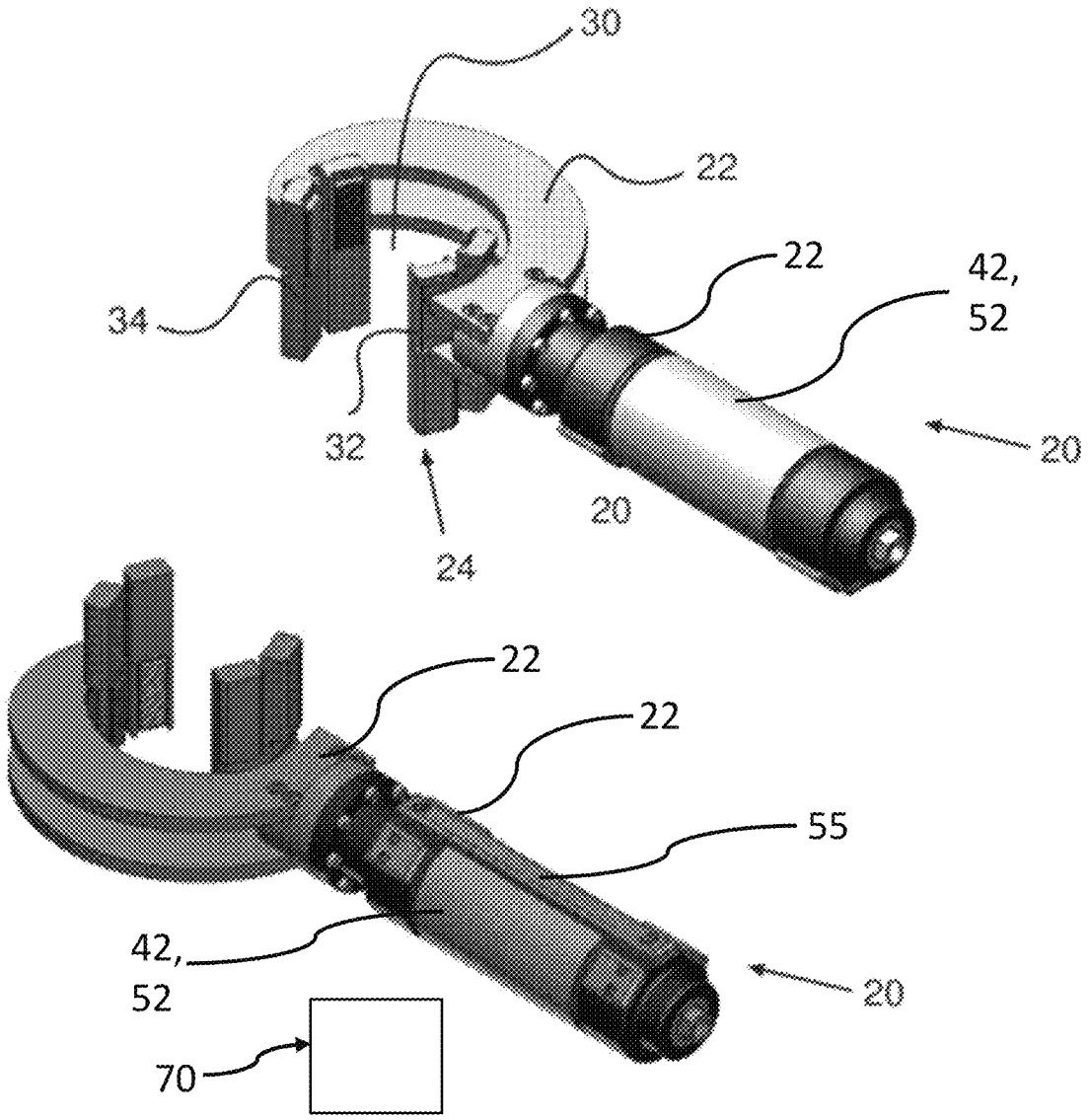
FIG. 2 discloses a safety device according to an embodiment of the invention seen in two views.
Figure 4:
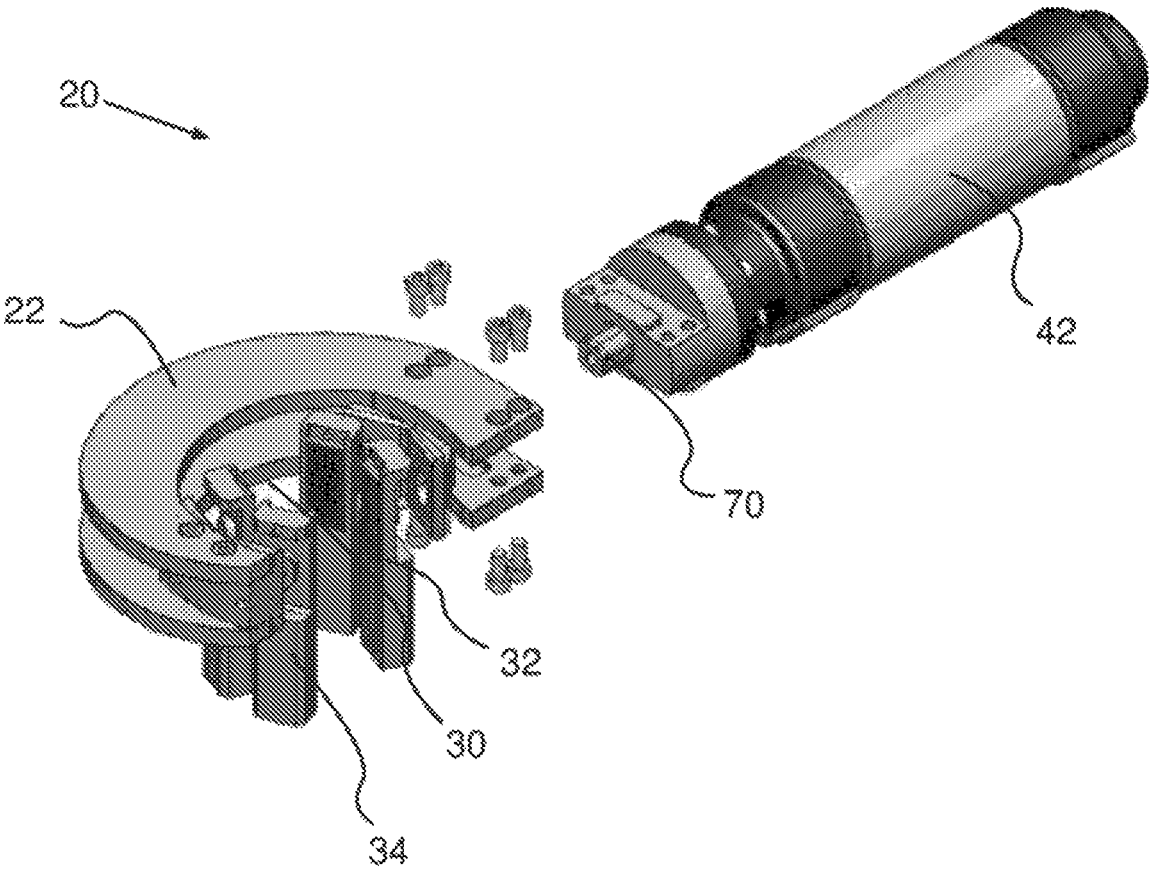
FIG. 4 discloses an exploded view of the safety device in FIG. 2.

In FIG. 2 a safety device 20 according to an embodiment of the invention is disclosed. The safety device 20 is seen from two different orientations. In FIG. 4 is an exploded view of the safety device 20 in FIG. 2 is disclosed.

The safety device 20 comprises a support structure 22 and a clamping arrangement 24. The support structure 22 comprises a recess 30 adapted to receive the envelope surface of the pipe section 12 of the pipe string 10.

The clamping arrangement 24 comprises a first engagement member 32 and a second engagement member 34 at the recess 30. The clamping arrangement 24 comprises a disengaged state in which the pipe section 12 is freely movable in respect to the device 20 and an engaged state in which the device 20 is firmly connected to the pipe section 12 of the pipe string 10.

The first engagement member 32 and the second engagement member 34 are arranged in different parts of the recess 30 so that opposite sides of the pipe section 12 are clamped between the first engagement member 32 and the second engagement member 34 when the clamping arrangement 24 is in the engaged state.

Figure 3A:
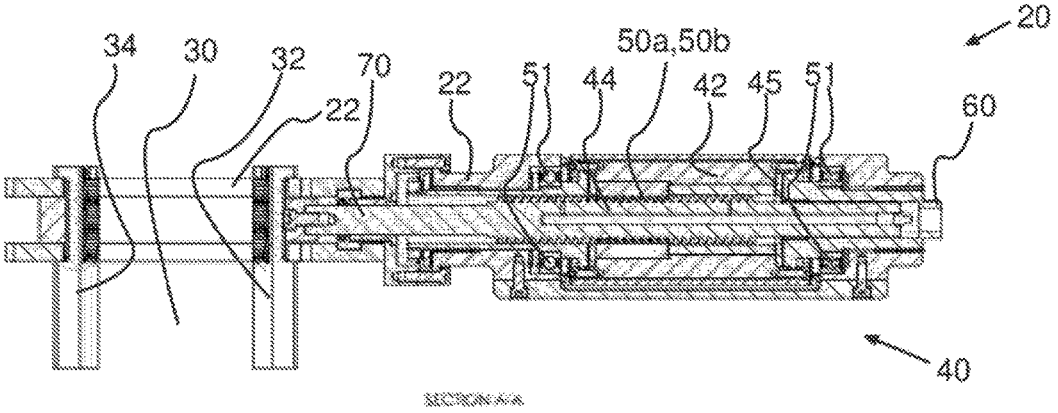
FIG. 3*a* discloses a first side view of the safety device in FIG. 2 seen along section A-A.
Figure 3B:
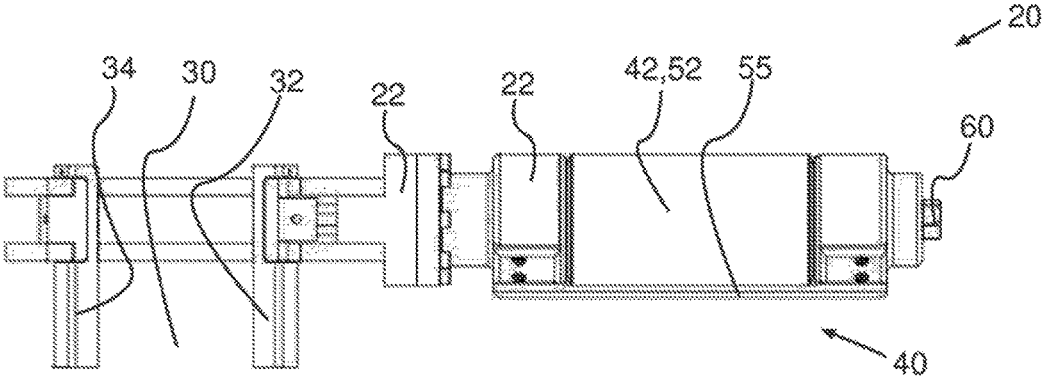
FIG. 3*b* discloses the safety device in FIG. 2 in the first side view.
Figure 3C:
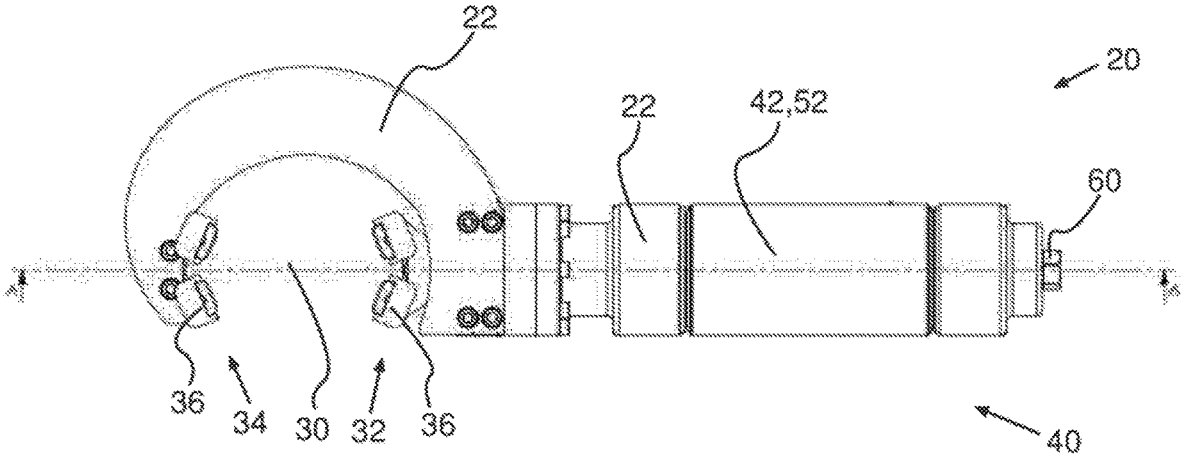
FIG. 3*c* discloses the safety device in FIG. 2 in a second side view.

With reference to FIGS. 3*a*-3*c*, the safety device 20 further comprises a clamping mechanism 40 for moving at least one of the first engagement member 32 and the second engagement member 34 towards and away from each other. In the disclosed embodiment, the clamping mechanism 40 is configured to displace the first engagement member 32 towards and away from the second engagement member 34, while the second engagement member 34 is arranged in a static position in relation to the support structure 22.

The first engagement member 32 and a second engagement 34 member comprise a contact member 36 comprising respective dies for contacting the envelope surface of the pipe section 12. Thereby, it is assured that a firm contact between the envelope surface and the engagement members 32, 34 is provided.

The clamping mechanism 40 is configured to act on at least the first engagement member 32 with a force that displaces the first engagement member 32 towards and away from the second engagement member 34. Furthermore, the first engagement member 32 is adapted to provide a clamping force to the envelope surface of the pipe section 12 when the clamping arrangement 24 is in the engaged state.

The clamping mechanism 40 comprises an elongated sleeve element 42 and a displacement rod 44. The sleeve element 42 comprises an opening adapted to allow the displacement rod 44 to be inserted. The sleeve element 42 comprises a spring element 45 that is compressed during engagement to provide a secure clamping force. Accordingly, once the clamping arrangement 24 has been changed to the engaged state, the engaged stated is configured to be maintained by means of the spring element 45 until the clamping arrangement 24 is shifted to the disengaged stated.

The sleeve element 42 comprises a primary threading 50*a* in the opening and the displacement rod 44 comprises a secondary threading 50*b*. The sleeve element 42 and the displacement rod 44 are positioned so that the primary threading 50*a* and the secondary threading 50*b* are engaging with each other. Accordingly, the primary threading 50*a* relates to an inner threading and the secondary threading 50*b* relates to an outer threading. Thereby, the sleeve element 42 and the displacement rod 44 have the function of a linear actuator.

The sleeve element 42 is adapted to be set into rotation. By means of the selected rotation direction of the sleeve element 42, the displacement rod 44 is displaced towards or away from the first engagement member 32.

The primary threading 50*a* and secondary threading 50*b* are arranged to engage with a friction force that holds the elongated sleeve element 42 and the displacement rod 44 fixed when the clamping arrangement 24 is in the disengaged state and the engaged state.

The opening of the sleeve element 42 is adapted to be provided with a lubricant. The clamping mechanism 40 further comprises a bearing element 51 at an intersection between the sleeve element 42 and the support structure 22. In the disclosed embodiment of the invention, two intersections are present between the sleeve element 42 and the support structure 22, and are provided with respective bearing elements 51.

The sleeve element 42 comprises connection means 52 adapted to enable connection to a robot arm/gripper 70 (refer to FIG. 2) for enabling the sleeve element 42 to be set into rotation around its longitudinal axis. In the disclosed embodiment, the connection means 52 comprises a cylindrical envelope surface that is adapted to be engaged by friction with a rotational roll of a tool, such as a rotational roll of a robot unit 70. WO2016/089216 discloses an example of such robot 70 with means for gripping and rotation. By means of the safety device 20 of the invention, a robot unit 70 can be used both for compiling the pipe string 10 and operating the safety device 20. Accordingly, by means of the invention, the process of the drilling operation comprising compiling the pipe string 10 and gradually shifting the pipe string 10 down the opening 7 of the assembly table 5 can be fully automated.

The support structure 22 further comprises a holding means 55 for enabling the device 20 to be held and moved to different locations. In the disclosed embodiment, the holding means 55 is form of a bar member extending along the sleeve element 42 with a separating gap. The holding means 55 is adapted to enable the device 20 to be held while allowing the sleeve element 42 to be set into rotation. The holding means 55 are adapted to prevent rotation of the device 20 as such while the device being held and the sleeve element 42 is set into rotation.

The sleeve element 42 comprises further connection means 60 adapted to enable connection to a tool for enabling the sleeve element 42 to be set into rotation in relation to its longitudinal axis. The further connection means 60 is in form of an external nut connected to the sleeve element 42. The further connection means 60 is for example a hexagonal nut. The connection means 60 provided an optional way of setting the sleeve element 42 into rotation in relation to its longitudinal axis, such as by a separate tool than a gripper arranged at a robot unit. Accordingly, further connection means 60 enables manual operation of the device 20.

The displacement rod 44 of the clamping mechanism 40 further comprises a portion 70 with a non-circular cross-section. The non-circular portion 70, here shown as rectangular, is slidingly arranged in a corresponding opening in the support structure 22, thereby preventing rotation of the displacement rod and thereby also the first engagement member 32.

Figure 5:
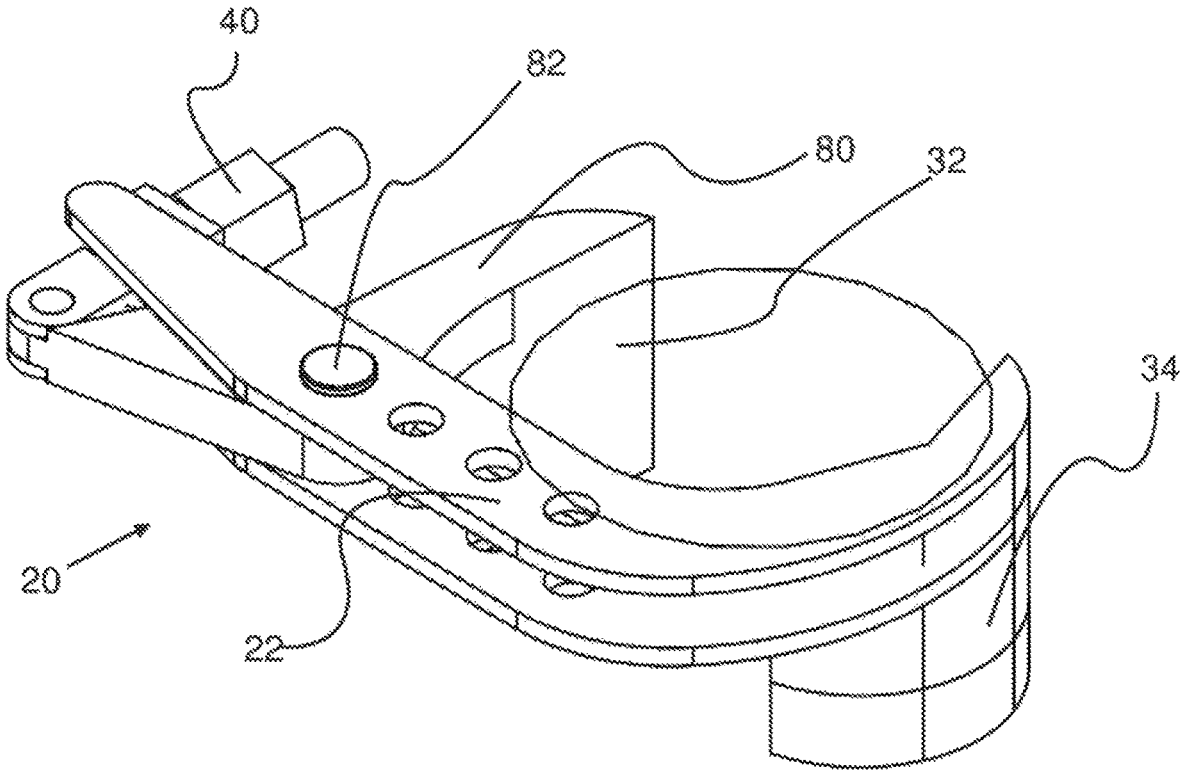
FIG. 5 discloses a safety device according to a further embodiment of the invention.

In FIG. 5 is a safety device 20 according to a further embodiment of the invention disclosed. The safety device 20 differs from the embodiment in FIGS. 2-4 in that the first engagement member 32 is rotationally arranged in respect to the support structure 22. The clamping mechanism 40 is configured to induce a rotation of the first engagement member 32 so that the first engagement member 32 is rotated towards and away from the second engagement member 34. Thereby, the clamping arrangement 24 is changed between the engaged state and the disengaged state.

The first engagement member 32 comprises an arm 80 and the clamping arrangement 24 comprises a pivot 82 between the arm 80 and the support structure 22. The clamping mechanism 40 is configured to act on the arm 80 with a force that rotates the arm 80 towards and away from the second engagement member 34. In the disclosed embodiment, the clamping mechanism 40 is arranged extending in a different direction that that the extension of the clamping mechanism 40 in the embodiment in FIGS. 2-4.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. Use of the verb "comprise" and its conjugations does not exclude the presence of elements or steps other than those stated in a claim. The article "a" or "an" preceding an element does not exclude the presence of a plurality of such elements. The mere fact that certain measures are recited in mutually different dependent claims does not indicate that a combination of these measures cannot be used to advantage.

The invention claimed is:

1. A safety system for a pipe string, the safety system comprising:

a safety device configured to attach to a pipe string, with the pipe string comprising a plurality of connected pipe sections;

an assembly of wedged slips configured to engage the pipe string, wherein, if the pipe string slips relative to the assembly of wedged slips, the safety device is configured to be displaced with the pipe string into contact with the assembly of wedged slips, and contact the assembly of wedged slips, when the assembly of wedge slips are engaged with the pipe string, so that a force from the assembly of wedged slips to the pipe string is increased in response to the contact of the safety device with the assembly of wedged slips, wherein the safety device comprises a support structure and a clamping arrangement comprising a first engagement member and a second engagement member, which clamping arrangement comprises a disengaged state in which the pipe string is freely movable in respect to the safety device and an engaged state in which the safety device is firmly engaged with the pipe string, wherein the support structure comprises a recess adapted to receive an envelope surface of the pipe string, and wherein the first engagement member and the second engagement member are arranged in different parts of the recess so that opposite sides of the pipe string are clamped between the first engagement member and the second engagement member when the clamping arrangement is in the engaged state; and a robot unit, wherein the safety device is a separate element configured to be gripped and operated by the robot unit, wherein the safety device comprises a clamping mechanism for moving at least one of the first engagement member and the second engagement member towards and away from each other, thereby changing the clamping arrangement between the engaged state and the disengaged state, wherein the clamping mechanism comprises an elongated sleeve element with an elongated opening comprising a primary threading, and a displacement rod comprising a secondary threading, wherein the displacement rod is arranged in the opening so that said primary threading and secondary threading engage with each other, and wherein the elongated sleeve element comprises further connection means adapted to enable connection to a tool for enabling the elongated sleeve element to be set into rotation in relation to a longitudinal axis of the elongated sleeve element.

2. The safety system according to claim 1, wherein the clamping mechanism is configured to act on at least the first engagement member with a force that displaces the first engagement member towards and away from the second engagement member.

3. The safety system according to claim 1, wherein engagement of the primary threading with the secondary threading creates a friction force that holds the elongated sleeve element and the displacement rod fixed when the clamping arrangement is in the engaged state.

4. The safety system according to claim 1, wherein the support structure further comprises a holding means for enabling the safety device to be held while allowing the elongated sleeve element to be set into rotation.

5. The safety system according to claim 1, wherein the elongated sleeve element comprises connection means adapted to enable connection to a robot arm for enabling the elongated sleeve element to be set into rotation in relation to a longitudinal axis of the elongated sleeve element.

6. The safety system according to claim 1, wherein the displacement rod comprises a portion with a non-circular cross-section fitting complementary and slidingly into an opening in the support structure.

7. A safety system for a pipe string, the safety system comprising:

a safety device configured to attach to a pipe string, the safety device comprising a support structure and a clamping arrangement, the support structure comprising a recess adapted to receive the pipe string, and the clamping arrangement comprising a first engagement member and a second engagement member, wherein, when the pipe string is received in the recess, the first engagement member and the second engagement member are arranged in the recess to be on opposite sides of the pipe string, wherein the first engagement member is configured to extend toward or retract from the second engagement member, wherein the second engagement member is configured to remain stationary relative to the support structure, and wherein the clamping arrangement comprises a disengaged state in which the pipe string is freely movable in respect to the safety device and an engaged state in which the safety device is firmly engaged to the pipe string, wherein the safety device further comprises an elongated sleeve element that is rotationally attached to the support structure, wherein rotation in a first direction of the elongated sleeve element relative to the support structure extends the first engagement member toward the second engagement member, and wherein rotation in a second direction of the elongated sleeve element relative to the support structure retracts the first engagement member away from the second engagement member; and a robot unit, wherein the safety device is a separate element from the robot unit and the robot unit is configured to rotate the elongated sleeve element relative to the support structure to extend or retract the first engagement member toward or away from the support structure and hold the support structure stationary relative to the robot.

8. The safety system of claim 7, further comprising an assembly of wedged slips, wherein if the pipe string slips relative to the assembly of wedged slips the safety device is configured to be displaced with the pipe string into contact with the assembly of wedged slips when the assembly of wedged slips is engaged with the pipe string, thereby interacting with the assembly of wedged slips so that a force from the assembly of wedged slips to the pipe string is increased in response to the contact of the safety device with the assembly of wedged slips.

9. A method for conducting a subterranean operation, the method comprising:

engaging a pipe string in an opening of a rig floor with an assembly of wedged slips;

gripping a safety device via a robot, the safety device comprising a support structure with a recess, a clamping arrangement with a first engagement member and a second engagement member, and an elongated sleeve member rotationally attached to the support structure;

holding, via the robot, the support structure stationary relative to the robot;

rotating, via the robot, the elongated sleeve member in a first direction relative to the support structure, thereby extending the first engagement member toward the second engagement member, with the second engagement member being stationary relative to the support structure; and engaging the pipe string with the first engagement member and the second engagement member in response to extending the first engagement member toward the second engagement member with the first engagement member and the second engagement member disposed in the recess on opposite sides of the pipe string.

10. The method of claim 9, further comprising:

displacing the safety device with the pipe string when the pipe string slips relative to the assembly of wedged slips; and increasing an engagement force of the assembly of wedged slips against the pipe string in response to the safety device interacting with the assembly of wedged slips when the safety device is displaced with the pipe string.

11. The method of claim 9, further comprising rotating, via the robot, the elongated sleeve member in a second direction relative to the support structure, thereby retracting the first engagement member away from the second engagement member, with the second engagement member being stationary relative to the support structure; and disengaging the pipe string from the first engagement member and the second engagement member in response to retracting the first engagement member away from the second engagement member.

* * * * *